United States Patent [19]

Connold

[11] Patent Number: 4,473,916

[45] Date of Patent: Oct. 2, 1984

[54] ACCESS MEANS

[75] Inventor: Kenneth Connold, Kent, England

[73] Assignee: GEC Mechanical Handling Limited, England

[21] Appl. No.: 458,470

[22] Filed: Jan. 17, 1983

[30] Foreign Application Priority Data

Feb. 24, 1982 [GB] United Kingdom ..... 8205435

[51] Int. Cl.[3] ..... E01D 15/00

[52] U.S. Cl. ..... 14/42; 14/43; 14/71.7; 14/71.5; 14/45

[58] Field of Search ..... 14/33, 42, 43, 45, 169.5, 14/71.1, 71.3, 71.5, 71.7; 414/138, 139

[56] References Cited

U.S. PATENT DOCUMENTS

| | | | |
|---|---|---|---|
| 3,875,603 | 4/1975 | Mampaey | 14/71.3 |
| 4,366,591 | 1/1983 | Zimmerman | 14/71.3 |

FOREIGN PATENT DOCUMENTS

| | | | |
|---|---|---|---|
| 812015 | of 1951 | Fed. Rep. of Germany | 52/632 |
| 2415771 | 9/1979 | France | 14/71.5 |
| 114682 | 9/1980 | Japan | 14/71.1 |

*Primary Examiner*—Ernest R. Purser
*Assistant Examiner*—Mark J. DelSignore
*Attorney, Agent, or Firm*—Kirschstein, Kirschstein, Ottinger & Israel

[57] ABSTRACT

A gangway designed to extend between a pair of relatively movable bodies (2, 50), such as an off-shore field rescue vessel and a rig or platform has a series of telescopic platforms (36, 37) defining a substantially planar walk-way surface and linked by a lazy-tong form of coupling (17, 18, 19, 20). By this means velocity variations between one region of the walk-way and the next can be kept small despite rapid variations in the overall length of the gangway.

7 Claims, 4 Drawing Figures

ACCESS MEANS

Figure 1:
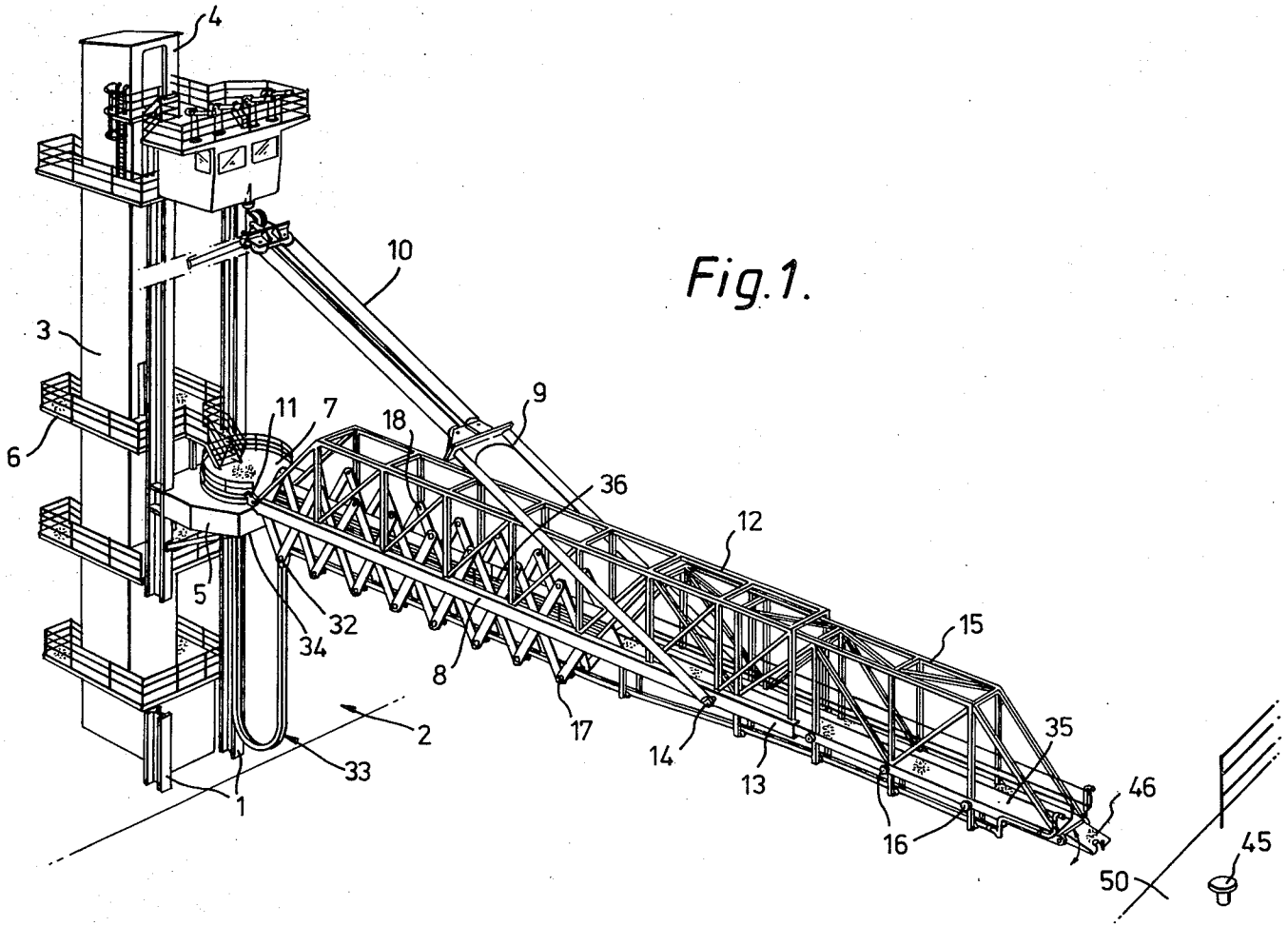

This invention relates to equipment for providing access means between two relatively movable bodies and is intended primarily but not exclusively to enable a gangway to be set up between a pair of such movable bodies. By use of the invention there is provided means by which pedestrians and/or light trucks or carriages may be transferred in either direction between the two bodies while the bodies are describing their relative movements to each other in a horizontal and/or a vertical direction.

One important object of the invention is the provision of such access means in a form whereby an abrupt velocity change at a particular point along the gangway, as would be a feature of a conventional "telescopic" layout, can be avoided, or at least significantly reduced, as the gangway lengthens or shortens. The benefits conferred by the invention thus include greater safety and comfort to persons using the access means.

According to the invention a gangway designed to extend between two bodies which are movable with respect to each other comprises an elongate support structure arranged to be secured to one of the bodies at one end, and carrying a series of platforms together forming a substantially planar walk-way surface, the platform at said one end being fixed in position and the remainder of the platforms being longitudinally slidable relative to the support structure, and each platform comprising a plurality of spaced longitudinally extending slats with the slats of adjoining platforms intermeshed to permit relative sliding movement of the platforms, the platforms being linked by a lazy-tong form of coupling, and the platform furthest from said one end of the support structure forming or being connected to an extension capable of being secured to the other body.

It will be seen that by the use of a plurality of platforms, the number depending on the length to which the gangway is arranged to be extended, variation in velocity from one region of the walkway to the next may be kept small, despite rapid variations in the overall length of the gangway.

In the above statement of invention the term "walkway" is not intended to mean that the gangway is suitable only for pedestrian traffic, and the gangway could also be used for wheeled transport, depending upon its dimensions and load carrying capacity, these being readily chosen in the design of the gangway in dependence upon the duties which it is required to perform.

Where the gangway is arranged to extend between two bodies which are movable relative to one another in at least one direction transverse to the longitudinal axis of the gangway, the means for connecting the support structure to the respective bodies must, of course, be such as to allow the appropriate angular movement to make place between the gangway and the bodies to accommodate such relative movement.

One application of the invention is for the provision of access means between an offshore oil field rescue vessel and a rig or platform which has to be evacuated for example because of an emergency or for some other reason. In such cases the body which it is desired to evacuate may be a fixed platform or alternatively may be a floating or semi submersible structure. Typically the rescue vessel will be either a semi submersible structure or a conventional ship. Thus it will be clear to those versed in the art that when both bodies having perhaps greatly varying characteristic responses to the seaway are to be connected by a gangway structure it is necessary for the two ends of the structure each to be three dimensionally movable relative to the other.

Accordingly in a gangway structure in accordance with the invention used for such purposes, or other instances where it is not only the distance between the two bodies that can vary, the means coupling the ends of the gangway to the two bodies must, of course, be such as to allow the required angular movement of the gangway to take place.

Thus each said coupling should be such as to permit a degree of pivoting movement of the gangway relative to the respective body, about nominally vertical and/or horizontal axes, depending upon the nature of relative movement of the bodies which could take place in use of the gangway.

One of the bodies conveniently carries an support platform pivotable with respect to the body about a nominally vertical axis, and the support structure is coupled to the support platform by means which permits the gangway to pivot with respect to the platform about a nominally horizontal axis extending transverse to the longitudinal axis of the gangway.

The support platform may also be movable in a nominal vertical direction relative to said one body to accommodate variations in the relative heights of the two bodies.

The support structure conveniently comprises a pair of channel members disposed parallel to each other with the mouths of the channels facing towards each other, the channel members being pivotally coupled to the support platform, and wherein the slidable platforms are supported by rollers longitudinally movable within the channels.

For enabling the slidable platforms to move relative to each other the gangway preferably incorporates a pair of lazy-tong structures located one at each side of the slidable platforms, each comprising a plurality of interconnected pairs of pivotally connected crossing members each of which carries a said roller at the crossing point. The slats of each slidable platform are conveniently connected to a cross member extending between the crossing points of corresponding crossing members of the two lazy-tong structures.

In such an arrangement the central parts of the slats are preferably connected to the respective cross member, and the ends of the slats are slidably supported on cross members extending between the crossing points of adjacent pairs of crossing members of the two lazy-tong structures.

The invention is directed towards the provision of a convenient and safe means whereby pedestrians may walk from one body to the other and whereby, for example, injured personnel may be transferred on stretchers or trolleys, even in the circumstances referred to above.

The gangway extension may be extended towards or retracted from said other body, for connection to or withdrawal from that body prior to or following the use of the gangway by hydraulic or mechanical means as may be appropriate, and the connection to the other body may be effected by fitting an opening or recess on the gangway extension over a co-operating pin or other projection. Alternatively the extension may incorporate a magnetic connector for attachment to a co-operating ferromagnetic region of said other body.

Figure 2:
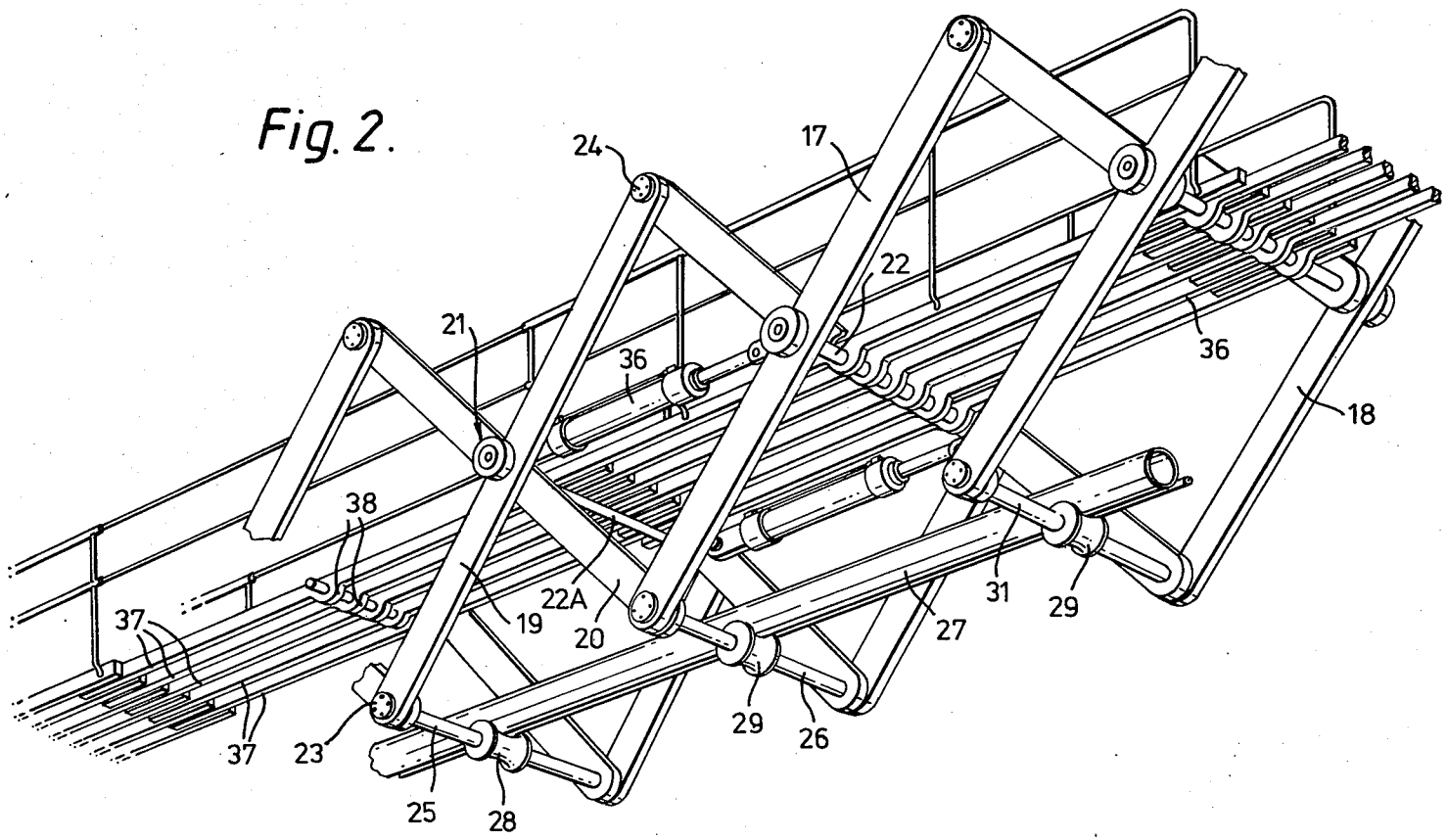
Figure 3:
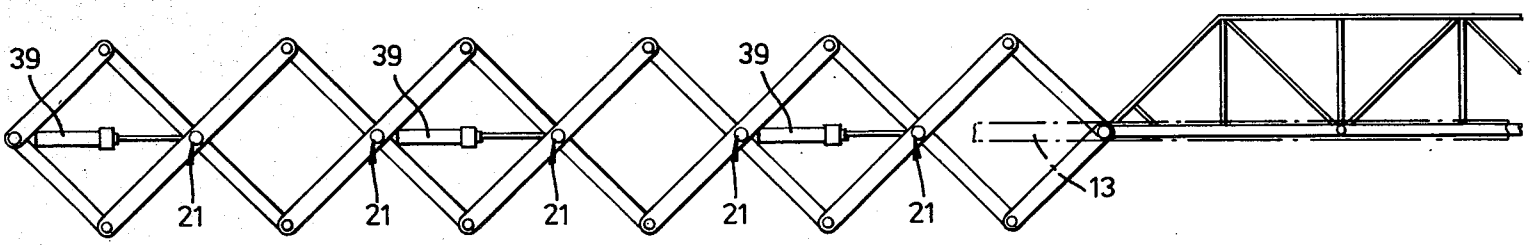
Figure 4:
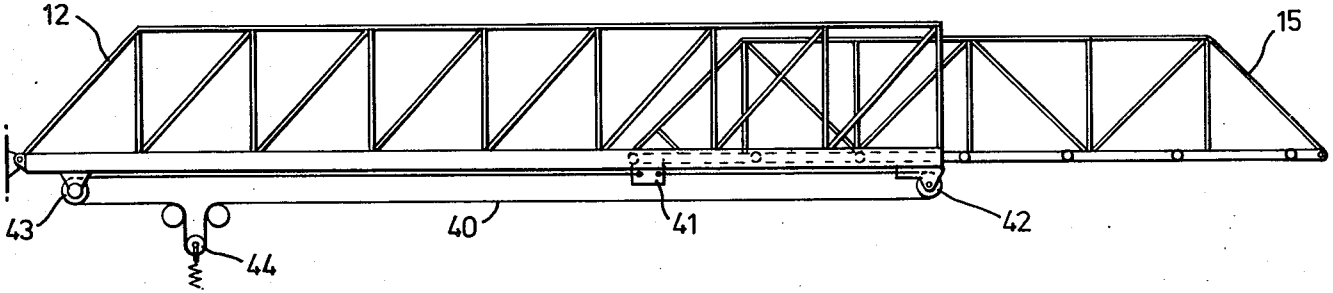

One embodiment of the invention will now be described by way of example and with reference to FIGS. 1 to 4 of the drawings attached hereto, in which FIG. 1 is a pictorial view of a telescopic gangway structure constructed in accordance with the invention, FIG. 2 shows an enlarged section of the gangway illustrating details of its construction, and FIGS. 3 and 4 illustrate two methods of controlling the extension or retraction of the gangway.

Referring first to FIG. 1 the gangway is supported from a vertical tower structure 1 erected at main deck level of the rescue vessel 2. The tower structure 1 incorporates a lift 3 of conventional design, the lift hoisting machinery room 4 being placed conveniently at the top of the structure. Cantilevered from the side of the structure is a landing platform 5 placed at a level to suit the rig platforms or other structures intended to be served by the emergency vessel. In an alternative construction (not shown) the platform 5 may be made vertically movable in order to increase the range of structures which can be served. The arrangement of the lift is such that its upper stopping position is at the level of a further platform 6 from which access may be gained to a circular platform 7 in the form of a turntable which is supported by means of a slewing ring (not shown) which in turn is carried on the landing platform 5.

Pivotally attached to the turntable 7 is a telescopic boom structure 8 which is supported by a yoke 9 and a boom luffing rope system 10. By means of a winch the boom luffing ropes may be lengthened or shortened thus causing the telescopic boom structure 8 to be rotated as a whole about the axis 11 so that the boom may be luffed to a level suitable for the deck of the rig platform or other body from which it is desired to evacuate personnel.

The telescopic boom structure as a whole will be seen to consist of a rigid boom 12 of rectangular cross section the lowermost members of which are constructed from channel members 13 which at their inboard end are connected to the boom pivot 11 and towards the outboard ends of which are connected the pivots 14 of the yoke 9.

Slidably supported within the rigid boom 12 is a rigid boom extension 15. This is carried on a plurality of rollers 16 attached to either side of the rigid boom extension 15 and arranged to move within and be supported by the channel members 13.

Mechanical connection between the inboard end of the rigid boom extension 15 and the boom pivot 11 is effected by means of a pair of "lazy tongs" structures 17 and 18.

Details of the construction of the lazy tongs can be understood from FIG. 2 where it will be seen that each lazy tong unit 17 and 18 consists of a pair of pivotally connected crossing members 19 and 20 at the centre point of which a roller 21 is placed which travels within the rigid boom side channel 13. Opposing centre points are joined by cross members 22. The ends of the lazy tong members 19 and 20 are pivotally connected at points such as 23 and 24 the lower pivots 23 being cross connected by members such as 25 and 26.

The walkway surface 35 of the rigid boom extension 15 is of normal construction and may for example be chequer plate open grid or timber construction. However that part of the walkway 36 which is associated with the lazy tongs section is of a construction designed to lengthen and shorten with the movement of the rigid boom extension 15 relative to the rigid boom 12. This construction can be seen most clearly in FIG. 2 and consists of a series of links 37 each of which is provided with an eye or lug 38 which is threaded on to a cross member 22. The lug is located in the centre of the link, each end of the link being slideably supported by adjacent cross members such as at 22A. Thus it will be seen that any one link 37 has three support points on adjacent cross members such as 22 the links being staggered transversely such that they interleave and form a substantially continuous surface over which pedestrians may walk and trolleys and the like may be wheeled providing they are equipped with tyres of adequate width. If desired cross members 22 may advantageously be equipped with rollers which can be placed between lugs 38 thus providing rolling contact between the ends of the links 37 and the cross members 22.

To the end of the lazy tong structure there is connected the inner end of walkway extension 35, the outer end of which is arranged to be connected to a rig or platform 50 being served by the emergency vessel 2 as will subsequently be described. At least the inner end of the walkway extension 35 is constructed of links in a similar manner to the telescopic sections of the walkway to permit it to extend or retract relative to the adjoining section of the walkway.

Conveniently the cross members 25 and 26 connecting the lower pivots of the lazy tong structure may be used to support a flexible hose array 27 via rollers 28 and 29 such an array being made use of to provide from the rescue vessel 2 services such as compressed air hydraulic fluid and wellhead kill fluid and also electrical signal connections required in connection with the monitoring and control of certain embodiments of the invention. The hose array 27 clamped to a cross member (not shown) beneath the walkway extension 35.

Reverting to FIG. 1 the inboard end of the hose array 27 passes over a radiused guide shoe 32 to form a loop 33 the lengthening and shortening of which permits the accommodation of the varying length of the telescopic boom assembly. The inboard terminating point for the hose array 34 is on the underside of the landing platform 5.

FIGS. 3 and 4 respectively illustrate two methods by which the in/out movement of the rigid boom 12 may be effected during the initial manoeuvring of the unit before mechanical connection to the rig or platform is achieved. FIG. 3 illustrates a method based on a plurality of hydraulic cylinders which are suitably placed between node points 21 of the lazy tong assemblies. In the example shown three such cylinders 39 are illustrated but this number may be more or less depending on the total number of elements which together form the lazy tong assembly. It will be understood that if the total movement in and out of the rigid boom extension 15 be x and the number of elements constituting the lazy tong assembly be y then the theoretical required stroke of the hydraulic cylinder 39 is (x/y).

FIG. 4 shows an alternative construction for the in/out drive of the rigid boom extension 15 in which an endless rope or chain system 40 is attached at a point 41 to the rigid boom extension 15 and runs over a pulley 42 attached to the rigid boom 12 and is powered by a winch 43 which may for example be hydraulically driven. The winch 43 is carried from the structure of the rigid boom 12 a suitable rope or chain tensioning device 44 may if desired be incorporated or alternatively the pulley 42 or the winch 43 may be slideably mounted on the structure of the rigid boom 12 such that either may be spring or hydraulically loaded to maintain tension in the rope or chain 40.

In one embodiment of the invention one or a number of gangway nose locating pins 45 are provided at suitable points on the deck edge of the rig or platform served by the emergency vessel and during the initial stages of connecting up the luffing slewing and boom in/out motions are used to fasten the boom assembly to the rig or platform 50 at a connecting assembly 46 at the end of the walkway extension 35 and adapted to be locked to the gangway nose locating pin 45. In this embodiment the slewing and boom in/out drives are bypassed as soon as this connection has been achieved and at the same time the luffing winch (not shown) which controls the boom luffing ropes 10 is placed in a "constant tension" mode such that an appropriate reaction passes into the boom 12 via the yoke pivot points 14. Thus it will be seen that under these circumstances it is the relative movement between the two bodies which produces angular and axial adjustment of the boom assembly to accommodate the varying distances and levels between the two bodies.

This first embodiment has the disadvantage that strong gangway nose locating pins 45 must be provided on the rig or platform which is to be served by the rescue vessel and limits the application of the rescue vessel to rigs or platforms so provided.

In an alternative embodiment of the invention the boom connector assembly 46 is provided with a magnetic connector which may be attached at any suitable point on the deck of the rig or platform. Under these circumstances suitable mechanical servo valves are incorporated in the connector assembly 46 so that the slewing and in/out motions may be under power at all times. Under these circumstances the reaction which must be passed through the magnetic base is greatly reduced as compared to that which must pass through the gangway nose locating pin 45 of the first embodiment.

I claim:

1. A gangway designed to extend between two bodies which are three-dimensionally movable with respect to each other comprising:

(A) a support platform mounted on one of said bodies and pivotable with respect to the body about a nominally vertical axis, (B) an elongate support structure incorporating a pair of channel members disposed parallel to each other with the mouths of the channels facing towards each other, (C) a first coupling connecting the support structure to the platform and permitting the support structure to pivot with respect to the support platform about a nominally horizontal axis extending transverse to its longitudinal, axis, (D) a series of platforms together forming a substantially planar walk-way surface carried by the support structure, (E) the walk-way platform at one end being fixed to the support structure and the remainder of the platforms being longitudinally slidable relative to the support structure, (F) each walk-way platform comprising a plurality of spaced longitudinally extending slats with the slats of adjoining walk-way platforms intermeshed to permit relative sliding movement of the platforms, (G) the walk-way platforms being linked by a pair of lazy-tong structures located one at each side of the slidable walk-way platforms, and each comprising a plurality of interconnected pairs of pivotally connected crossing members each of which carries a roller at the crossing point longitudinally movable within a respective channel, (H) the slidable walk-way platform furthest from said one end of the support structure forming or being connected to an extension having a second coupling for securing the extension to the other body, which coupling is such as to permit a degree of pivoting movement of the gangway relative to the body about nominally vertical and horizontal axes.

2. A gangway according to claim 1 wherein the support platform is movable in a nominal vertical direction relative to said one body.

3. A gangway according to claim 1 in which the slats of each slidable platform are connected to a cross member extending between the crossing points of corresponding crossing members of the two lazy-tong structures.

4. A gangway according to claim 3 in which the central parts of the slats are connected to the respective cross member, and the ends of the slats are slidably supported on cross members extending between the crossing points of adjacent pairs of crossing members of the two lazy-tong structures.

5. A gangway according to claim 1 wherein the linear movement of the gangway, for enabling the gangway extension to be extended towards or retracted from the said other body, is effected by hydraulic piston and cylinder units.

6. A gangway according to claim 1 wherein the extension or retraction of the gangway, for enabling the extension to be extended towards or retracted from the said other body, is effected by a winch driven rope or chain.

7. A gangway according to claim 1 in which the end of the extension is provided with an opening or recess adapted to fit over a co-operating pin or other projection on said other body.

* * * * *